US009107802B2

(12) United States Patent
Sharpe et al.

(10) Patent No.: US 9,107,802 B2
(45) Date of Patent: Aug. 18, 2015

(54) TABLET CRUSHER WITH ROCKER ACTION

(75) Inventors: Gary L. Sharpe, Naples, FL (US); Doug Clouser, Galloway, OH (US)

(73) Assignee: Gary L. Sharpe, Naples, FL (US)

( * ) Notice: Subject to any disclaimer, the term of this patent is extended or adjusted under 35 U.S.C. 154(b) by 137 days.

(21) Appl. No.: 13/614,784

(22) Filed: Sep. 13, 2012

(65) Prior Publication Data

US 2013/0240653 A1 Sep. 19, 2013

Related U.S. Application Data

(60) Provisional application No. 61/534,042, filed on Sep. 13, 2011.

(51) Int. Cl.
*B02C 1/10* (2006.01)
*A61J 7/00* (2006.01)

(52) U.S. Cl.
CPC . *A61J 7/0007* (2013.01); *B02C 1/10* (2013.01)

(58) Field of Classification Search
CPC ..... A61J 7/0007; B02C 19/08; B02C 1/10
USPC ..... 241/264–269, 168, 169, DIG. 27, 169.2
See application file for complete search history.

(56) References Cited

U.S. PATENT DOCUMENTS

| | | | | |
|---|---|---|---|---|
| 2,176,552 | A * | 10/1939 | Pasquale Vocaturo | 241/84.3 |
| 5,924,636 | A * | 7/1999 | Calderon | 241/84.3 |
| 6,637,683 | B1 * | 10/2003 | (Lomax) Wilbur | 241/101.2 |
| 6,637,685 | B1 * | 10/2003 | Kruger | 241/169.1 |
| 7,252,254 | B1 | 8/2007 | Engel | |
| 7,413,137 | B2 * | 8/2008 | Donovan | 241/168 |
| 7,559,496 | B2 * | 7/2009 | Shewchuk | 241/169 |

OTHER PUBLICATIONS www.Amazon.com, Wusthof 9-inch Double Mezzaluna, Nov. 2010.*
www.amazon.com, Furi Rachael Ray Froggy Double Bladed Mezzaluna Cutting Gadget, Jan. 2008.*

* cited by examiner

*Primary Examiner* — Mark Rosenbaum
(74) *Attorney, Agent, or Firm* — Standley Law Group LLP

(57) ABSTRACT

A device for crushing one or more tablets and methods of using the same are disclosed. The device contains a solid body portion having a blade-like configuration. Round grips extend from the opposing ends of the body portion. The body portion has a crushing surface that is convex. The convex surface allows the device to be operated in a rocking motion.

14 Claims, 3 Drawing Sheets

DIMPLE PATTERN
DETAIL A
SCALE 2 : 1
DIAMOND SERRATIONS
Ø2.000
.69
3.80
2.800
6.40
8.400
6.175
R10
R7.6
3
1

TABLET CRUSHER WITH ROCKER ACTION

CROSS-REFERENCE TO RELATED APPLICATIONS

This application claims priority to U.S. Patent Application No. 61/534,042, filed on Sep. 13, 2011 and herein incorporates the application in its entirety.

TECHNICAL FIELD

The disclosed embodiments relate generally to a device for crushing a pill or tablet, to facilitate administration to a patient.

BACKGROUND OF THE ART

It is a simple combination of medical advances and demographics that has caused a great increase in the need for crushing pre-formed medication tablets for proper ingestion by patients having diminished swallowing capabilities. At one point, medications, such as "headache powders" were dispensed in a powdered form. As the technology of the pharmaceutical industry improved, it became possible to form very carefully measured dosages of the medications in a compressed, pre-formed tablet. While the tablet is extremely useful to the pharmaceutical manufacturer in dispensing precise numbers of dosages that can be handled in a clean and efficient manner, the tablet may present significant difficulties to the patient, especially the elderly, the weakened and those with swallowing difficulties. As the number of medications increases, the number of patients who have difficulty with swallowing has also increased.

A number of devices in the prior art are available, including several that are produced by the owner of this application. These devices commonly provide a lever action that juxtaposes a pair of faces, between which the tablet or pill is placed. In a medical institutional setting, these devices are useful when they are used in a preparation room, but they tend to be too bulky and/or too noisy to use in a patient room, where it is often necessary to prepare the dosage without disturbing the patient. Being able to do this while obtaining a small average particle size, with substantially all particles being able to pass a small screen, is an ongoing challenge in the industry.

In many of the prior art solutions, the devices act to bring the opposing faces together in a substantially vertical plane. As a result, particles that are broken away from the pill, especially in the initial breakage, can fall by gravity out of the field where the most active crushing is occurring. This can result in no further, or secondary, crushing of the particle, with the result of a larger average particle size.

It is therefore an advantage of the embodiments disclosed herein to provide a pill crushing device that provides at least some of the desired objectives.

SUMMARY

Embodiments of the inventive tablet crusher have several advantages over existing devices, by providing a tablet crusher having a blade-like body portion and round grips extending therefrom. The round grips make it easy for the elderly to grasp the inventive tablet crusher and apply downward pressure to the device to crush the tablets. Specifically, the rounded grips also allow an individual to apply a downward pressure to the device without the need to actual grasp the round grips. To ensure easy application of this downward pressure the rounded grips extend from the body of the device in an oblique manner. The rounded grips and the angle at which they extend from the body portion allow a user with arthritis to use the device.

The body portion that contacts the pill has a convex shape decreasing the area over which the force is applied, thus decreasing the amount of force necessary to crush a tablet. In addition, the convex shape allows the tablet crusher to be used in a rocking fashion making the inventive device both easier and quieter to use.

An optional base may also be provided to both store the device and to provide a surface on which to crush the tablets. The base may have a horizontal surface for interfacing with the convex surface for the device, and channels to hold the body in an upright position. During use, tablets may be placed between the convex surface of the body and the horizontal section of the base for crushing. The design of the device also allows for the use of tablet pouches. The tablet pouches may be used to ensure that the particles of crushed tablets remain in the working zone of the device.

These advantages are provided by a tablet crusher as described in more detail in the detailed description and drawings provided herewith.

BRIEF DESCRIPTION OF THE DRAWINGS

The advantages and other characteristics of the disclosed embodiment will better understood when attention is directed to the accompanying drawings, wherein identical elements are identified with identical reference numerals and wherein.

DETAILED DESCRIPTION OF A PREFERRED EMBODIMENT

Figure 1:
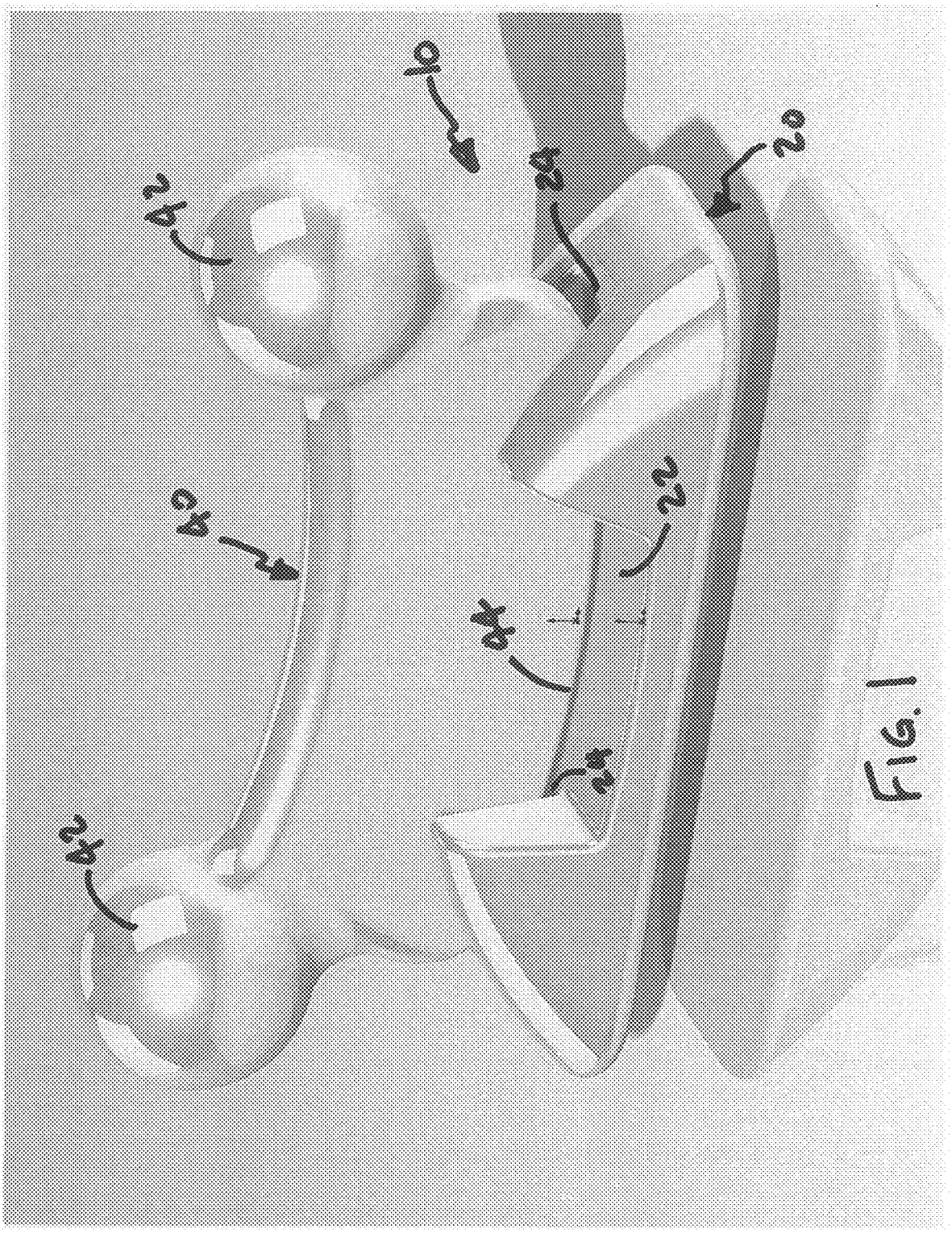
FIG. 1 is a front perspective view of an embodiment of the tablet crusher with rocking device, in association with an optional base piece.

Directing attention to the drawings, and particularly to FIG. 1, a front perspective view is provided for an embodiment 10 of a tablet crusher having a rocking action. As illustrated, the embodiment 10 is constructed in two pieces, the first of which is a crusher body 40 and the second of which is a base unit 20. In the assembled condition of FIG. 1, the embodiment 10 can be used crush a tablet that is placed on a generally horizontal surface 22 of the base unit 20, with the crusher body 40 held in a generally vertical plane between a pair of channels 24 that are adjacent to the horizontal surface. Throughout this detailed description, references to a "pill" or a "tablet" in the singular should be understood as extending to the plural "pills" or "tablets", unless the extension is specifically excluded. Positioned in this manner, a user may exert a downward force in a rocking manner, using the rounded grips 42 to bear down on a tablet (not shown) on the horizontal surface 22. As will be explained in more detail below, the horizontal surface 22, as well as the extensions of that surface into the base of channels 24 is generally horizontal (has a substantially infinite radius of curvature in the upward direction) or is upwardly concave with a radius of curvature that is much larger than a downwardly convex surface that constitutes a contact surface 44 of the crusher body 40. This difference in the radii of curvature allows the rocking action and the concentration of force by reducing a contact area between the respective surfaces 22, 44.

Figure 2:
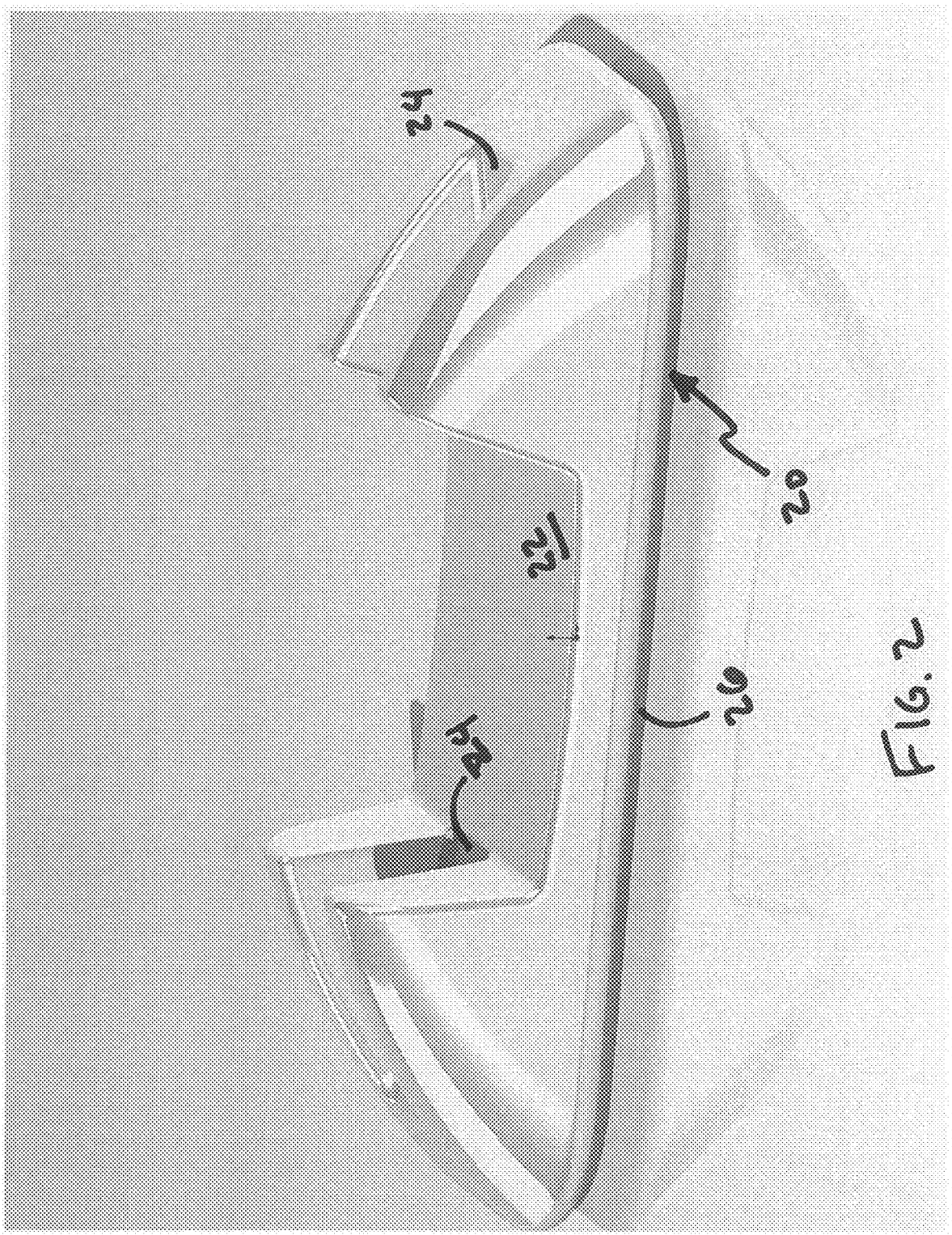
FIG. 2 is a front perspective view of the optional base piece of the FIG. 1 embodiment, isolated from the tablet crusher.

A better view of the base unit 20 is provided in the further front perspective view of FIG. 2, where the base unit is shown isolated from the crusher body. In this view, the details of the horizontal surface 22 and the channels 24 can be better appreciated. Also notable in FIG. 2 is a bottom surface 26 of the base unit 20. This bottom surface 26 is clearly planar and covers a rectangular area that is both wider and longer than the area upon which the crushing force from crusher body 40 will be imposed. Although not specifically shown and not required, it is preferred to provide a cushioning material, such as a foamed elastomer, on surface 26. The cushioning material operates to cushion the force against the table or other surface on which the device is used, to deaden sound generated by preventing propagation of the sound into the underlying surface and to minimize sliding or slipping of the unit while in use. The base unit 20 is made of a rigid material. While it may be formed from metal, a rigid thermoplastic, particularly a polyurethane, may be preferred over metal, due to the reduced weight for being carried by a medical practitioner dispensing medication to patients.

Although it may be useful to provide a thin layer of a polymeric material on horizontal surface 22 to facilitate holding a pouch in place while a pill or tablet in the pouch is being diminuted or crushed. It is not desirable to use a layer of material that is thick enough to provide cushioning effect that would significantly decrease the crushing force applied.

As mentioned above, the use of the base unit 20 is optional, although it is preferred. In the absence of the base unit, the crusher body can be used on a pill or tablet contained in a pouch placed on any suitable substantially flat surface that will remain rigid during the application of the crushing force.

Figures 3, 4, 5, 6, 7, 8:
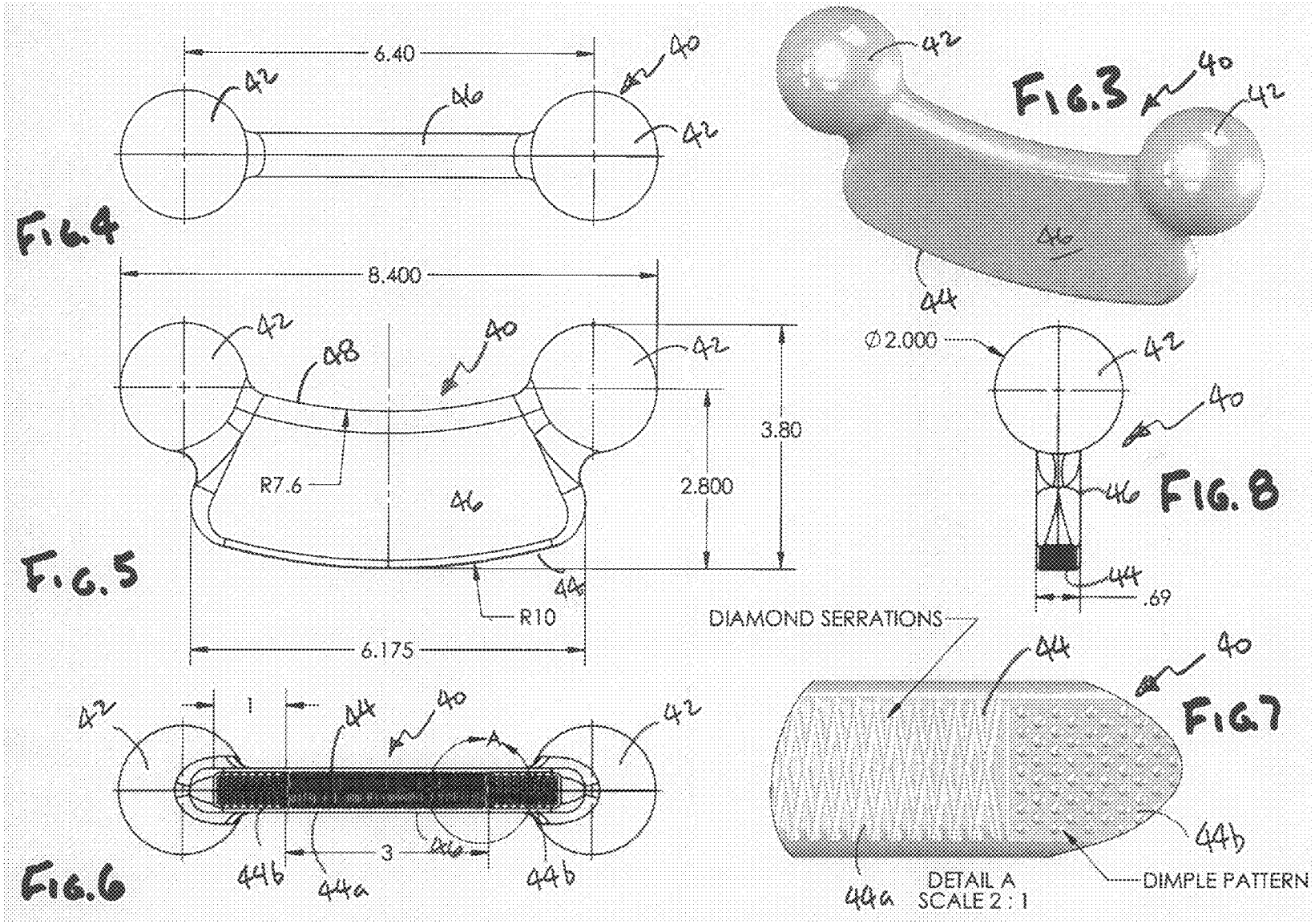
FIGS. 3 through 8 are various views of the FIG. 1 tablet crusher body, isolated from the optional base piece.

Directing the attention now to FIGS. 3 through 8, several views of the tablet crusher body 40 are better understood. The first of these views, in FIG. 3, is a perspective view of the crusher body 40. Although many devices that are known in this and related arts will use a centrally-directed force, as would be applied by one hand of a user directly above the item being crushed, the crusher body 40 of this embodiment has a pair of rounded hand grips 42 through which force is applied. The majority of the mass of the crusher body 40 is concentrated in a blade-like body portion 46. This body portion 46 is preferably solid, and more preferably, a generally rectangular solid.

FIG. 4 shows a top plan view of the crusher body 40. It can be seen that, in this embodiment, the rounded grips 42 have a diameter that is almost three times as large as the thickness of the body portion 46 and that the body portion itself has a length that is about ten times its thickness. The rounded grips 42 extend outward from the upper corners of the body portion in an almost oblique manner.

FIG. 5 provides a front elevation view of the crusher body 40. The placement of the rounded grips 42 relative to the overall body portion 46 is readily seen in this view. In this embodiment, the height of the body portion 46 is observed as being about one-half of the length dimension and the height is about four times the thickness. While the upper surface 48 is depicted as having a upwardly concave nature, this curvature is a matter of design and not function, as the upper surface can be flat. As seen here and in the other views, the disclosed embodiment is formed in a unitary piece, such as by molding or casting.

FIG. 6 is a bottom plan view of the crusher body 40 and shows an additional feature that has not been previously discussed. The length dimension of the contact surface 44 is effectively demarcated into a central zone 44*a* and a pair of end zones 44*b*. The central zone 44*a* has a length that is about three times the length of either of the end zones 44*b*, which are of equal length. A circled area A in FIG. 6 is shown in enlarged view in FIG. 7, where the transition from a central zone 44*a* to an end zone 44*b* depicted. The central zone 44*a* has a regular pattern of diamond-shaped serrations imposed on it, while the adjacent end zone 44*b* has a regular pattern of raised dimples. These imposed surface patterns are of an exemplary nature, but are functional in providing effective crushing of the items being processed.

FIG. 8 provides an end elevation view of the crusher body 40, but all features shown in this view have been described above.

A general observation of the two pieces used in this embodiment 10 is that they are easily separated from each other, especially for cleaning, as they are not directly connected to each other and they function without any direct connection. This lack of a leveraged connection between the two pieces (as in many other crusher devices) during operation means that there is no minimum separation between the contact surface 44 of the crusher body 40 and the surface against which it is acting, whether that is provided by the base unit 20 or another surface.

It is anticipated that pill crusher pouches that are already commercially available will be suitable for use with the embodiment 10.

While the person of skill in this art will be readily able to determine appropriate materials for the individual parts, the crusher body 40 will be preferably molded from a rigid thermoplastic material, especially a polyurethane, for weight considerations, although metal is useful and preferred if the device is intended to remain in a fixed location instead of being carried around.

While the embodiments disclosed describe the best modes known to the inventor at the time of filing, the scope of the invention is not to be limited to only the embodiments disclosed herein.

What is claimed is:

1. A device for crushing one or more tablets, comprising:

a body portion having a generally rectangular solid shape having upper corners and a contact surface, said contact surface having a convex shape; and rounded grips extending outwardly and obliquely from said upper corners of said body portion, wherein said contact surface is patterned with a central zone having a first pattern and a pair of end zones having a second pattern wherein the first and second patterns may be similar or different, and is configured to crush the one or more tablets by a rocking motion imparted by said rounded grips.

2. The device of claim 1, wherein said rounded grips have a diameter almost three times a thickness of said body portion.

3. The device of claim 1, further comprising a base unit, comprising:

a horizontal surface; and a pair of channels adjacent to said horizontal surface.

4. The device of claim 3, further comprising a thin layer of polymeric material on said horizontal surface.

5. The device of claim 3, wherein said base unit further comprises a bottom surface having a generally rectangular shape.

6. The device of claim 5, further comprising a foamed elastomer affixed to said bottom surface.

7. A device for crushing one or more tablets, comprising:

a body portion having a generally rectangular solid shape having upper corners, said body portion having a downwardly convex contact surface; and a pair of rounded grips extending obliquely from said upper corners of said body portion, wherein said contact surface is patterned with a central zone having a first pattern and a pair of end zones having a second pattern wherein the first and second patterns may be similar or different, and is configured to crush the one or more tablets by a rocking motion imparted by said rounded grips.

8. The device of claim 7, further comprising a base unit having a horizontal surface and a pair of channels adjacent said horizontal surface.

9. The device of claim 7, wherein said rounded grips have a diameter about three times as large as a thickness of said body portion.

10. The device of claim 7, wherein said body portion has a length about ten times a thickness of said body portion.

11. The device of claim 7, wherein said body portion has a height about one-half the length of a height of said body portion.

12. The device of claim 7, wherein said body portion and said rounded grips have a unitary design.

13. A device for crushing one or more tablets, comprising:

a blade-like body portion having a generally rectangular solid shape having upper corners and a downwardly convex patterned contact surface, said body portion having a length approximately ten times its thickness; and a pair of rounded grips extending obliquely from said upper corners of said body portion, said rounded grips having a diameter approximately three times as large as the thickness of said body portion, wherein one or more tablet is crushed under said contact surface by a rocking motion imparted by said rounded grips.

14. The device of claim 13, further comprising:

a base unit, including:

a horizontal surface having a pair of channels thereon to vertically receive said blade-like body portion, said horizontal surface allowing a rocking motion of said blade-like body portion.

* * * * *